United States Patent [19]

Stiefel

[11] Patent Number: 4,690,337

[45] Date of Patent: Sep. 1, 1987

[54] ROLL CUTTING MACHINE FOR COMMINUTION OF BULKY REFUSE

[76] Inventor: Jakob Stiefel, Lindenhof 4, 8604 Volketswil, Switzerland

[21] Appl. No.: 809,326

[22] Filed: Dec. 16, 1985

[30] Foreign Application Priority Data

Jul. 17, 1985 [CH] Switzerland ..... 3105/85

[51] Int. Cl.[4] ..... B02C 13/00

[52] U.S. Cl. ..... 241/36; 241/37; 241/167; 241/236; 241/285 A; 241/285 B; 241/243

[58] Field of Search ..... 241/33, 36, 37, 166, 241/167, 235, 236, 239, 241, 243, 285 R, 285 B, 285 A

[56] References Cited

U.S. PATENT DOCUMENTS 2,243,492 5/1941 Wilson ..... 241/235 X 4,385,732 5/1983 Williams ..... 241/236

*Primary Examiner*—Timothy V. Eley

*Attorney, Agent, or Firm*—Werner W. Kleeman

[57] ABSTRACT

Two rolls which carry roll teeth rotate, as seen from their top side, in directions away from their common roll nip or gap towards adjacent hopper wall sections which carry hopper teeth. The refuse is thus loosened instead of being compacted in the common roll nip or gap, as in the prior art. The loosened material is more readily cut than the material which hitherto was compacted in the common roll gap. At a predetermined limiting load between the roll teeth and the hopper teeth, at least the hopper wall section which carries the affected hopper teeth, is retracted from the associated roll by a drive and from its operative position depicted on the right in FIG. 2 into an inoperative position depicted on the left in FIG. 2. The interfering material can fall through downwardly, whereupon the hopper wall section returns towards the associated roll into its operative position. No hopper blockage can occur.

10 Claims, 3 Drawing Figures

ROLL CUTTING MACHINE FOR COMMINUTION OF BULKY REFUSE

BACKGROUND OF THE INVENTION

The present invention broadly relates to a new and improved construction of a roll cutting machine for comminution of bulky refuse or the like.

In its more particular aspects, the present invention specifically relates to a new and improved construction of a roll cutting machine for comminution of bulky refuse or the like and which comprises a charging hopper in which two rolls or rollers are provided. The two rolls or rollers are arranged axially parallel to each other and are rotatably driven in opposite directions of rotation. A common roll nip or gap is formed between these two rolls. Each roll possesses roll teeth or cutters which are arranged at axially spaced annular or ring zones.

A machine of this type is known, for example, from German Pat. No. 1,507,485, published Mar. 5, 1970.

In the known roll cutting machines the rolls pull or draw the refuse to be comminuted or cut into the common roll nip or gap where the refuse is comminuted or cut by the cooperation of the rolls. When a limiting load is reached, the rolls are automatically stopped and temporarily reversed, whereupon they are again rotated in the original direction. When the limiting load is reached again, then this reversing process is repeated or the roll cutting machine is stopped. If the condition cannot be eliminated, then the hopper must be emptied towards the top during the shut-down of the roll cutting machine. Such emptying operation naturally is cumbersome, time-consuming and expensive. Therefore such roll cutting machine can only be operated under constant supervision when it is desired to avoid long shut-down periods.

SUMMARY OF THE INVENTION

Therefore, with the foregoing in mind it is a primary object of the present invention to provide a new and improved construction of a roll cutting machine for comminution of bulky refuse or the like and which does not exhibit the aforementioned drawbacks and shortcomings of the prior art constructions.

A further important object of the present invention is to provide a new and improved construction of a roll cutting machine for comminution of bulky refuse and which is economical to run, does not require constant supervision, and is not readily subject to breakdown or malfunction.

Now in order to implement these and still further objects of the invention, which will become more readily apparent as the description proceeds, the roll cutting machine of the present development is manifested by the features that, the two rolls are rotatably drivable, when viewing the rolls from above or from their top side, in a direction away from the common roll nip or gap, towards the related adjacent hopper wall sections. Each roll tooth or cutter cuttingly passes through a related spacing between related hopper teeth in the lower portion of the associated hopper wall section when the hopper teeth are in their operative position. The hopper teeth of each hopper wall section can be displaced away from the associated roll into an inoperative position at a predetermined force effective between the hopper teeth and the roll teeth or cutters. A preselected number, i.e. either individual or combinations of a preselected number of hopper teeth can be displaced under these conditions.

Due to the fact that the two rolls rotate, when viewing their top side, in a direction away from the common roll nip or gap towards the related hopper wall sections, the two rolls can loosen and tear apart the refuse, whereas in the prior art roll cutting machines the refuse rather was compacted in the common roll nip or gap, whereby the cutting effectiveness was reduced.

The refuse which thus has been loosened in the inventive roll cutting machine is now more easily comminuted or reduced in size by means of the roll teeth as they pass through between the hopper teeth.

If nevertheless the case occurs that some material simply cannot be cut within the limiting load defined by the roll cutting machine, then the hopper teeth are displaced into their inoperative position, i.e. displaced away from the related rolls. The uncuttable material can pass through downwardly at the rolls and past the hopper wall sections. The hopper teeth then can be returned into their initial or operative position. The hopper cannot become blocked or jammed and practically never needs to be cleared from the top in the case of an emergency. A large amount of refuse, therefore, can be fed directly into the hopper, whereas hitherto only small portions of refuse could be infed and had to be removed from above in the case of machine blockage.

Since the rolls work away from each other, a slowing or stopping of one roll does not impair the performance of the other roll. Individual drives or drive means practically can result in complete independence of the rolls. In known roll cutting machines the rolls are "coupled" to each other, even in the case of individual roll drives, due to the interengaged or meshing teeth and the material to be comminuted, to such extent that the rolls always positively run or stop together.

It is advantageous when the hopper teeth of each hopper wall section are pivotable about a pivot axis which is axially parallel to the rolls. This pivot axis is normally situated above the hopper teeth because then a greater region is available for release of the refuse and results in a quasi widening of the hopper itself.

A positive drive of the hopper teeth for displacement into their inoperative position and back into their operative position has the advantage that the hopper teeth can be very rigidly or firmly held in their operative position and that such rigid holding of the teeth in their operative position is only released if required.

In such arrangement, a hydraulic drive or drive means can render very good service since a pressure change in the hydraulic drive or drive means may serve for releasing the displacement of the hopper teeth into their inoperative position.

The triggering of the displacement of the hopper teeth into their inoperative position can also be effected in response to the operating pressure of the roll drive or drive means either individually or together with the operating pressure of the hopper teeth drive or drive means.

Regardless of which method is used, one row of hopper teeth can be displaced into its inoperative position without negatively affecting the other row of hopper teeth, so that at least half the machine output can be maintained.

Preferably, annular grooves are provided between the annular zones, which extend close to the related hopper teeth and carry the roll teeth or cutters, and each of such annular grooves is constructed so as to significantly recede from the related or opposite hopper tooth. There is thus achieved the result that cut material cannot downwardly pass only where it is downwardly entrained by a roll tooth. Nevertheless, no uncut material can fall through this structure because the annular zones which carry the roll teeth or cutters extend very close to the hopper teeth.

An offset of the roller teeth or cutters in circumferential direction enhances the cutting performance insofar as always only a part or, in fact, only one of the roll teeth or cutters acts in a cutting manner.

No cutting operation occurs in the common roll nip or gap in the inventive roll cutting machine and, therefore, no interengagement or meshing of the roll teeth or cutters is required in the inventive roll cutting machine. On the contrary, it is an advantage that the roll teeth or cutters extend only up and close to the common roll nip or gap. This aids in the loosening of the refuse during the tearing operation and allows the hopper cross-section to be maximized for one and the same or a given roll dimension.

The large applicable forces already make it desirable in the known roll cutting machines to have an individual drive or drive means for each roll because gear wheels quickly wear out under such conditions and are also expensive. The individual drives or drive means for the rolls in the inventive roll cutting machine also assist the independent operation of the rolls, so that the individual drive or drive means are doubly useful.

A hydraulic drive or drive means is considered particularly economic when operating in combination with free-wheel mechanisms which are alternatingly or selectively driven or operated by suitable hydraulic units.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same of analogous components and wherein:

FIG. 1 is a top plan view of an exemplary embodiment of a roll cutting machine constructed according to the invention for comminution of bulky refuse or the like;

DETAILED DESCRIPTION OF THE PREFERRED EMBODIMENTS

Figure 1:
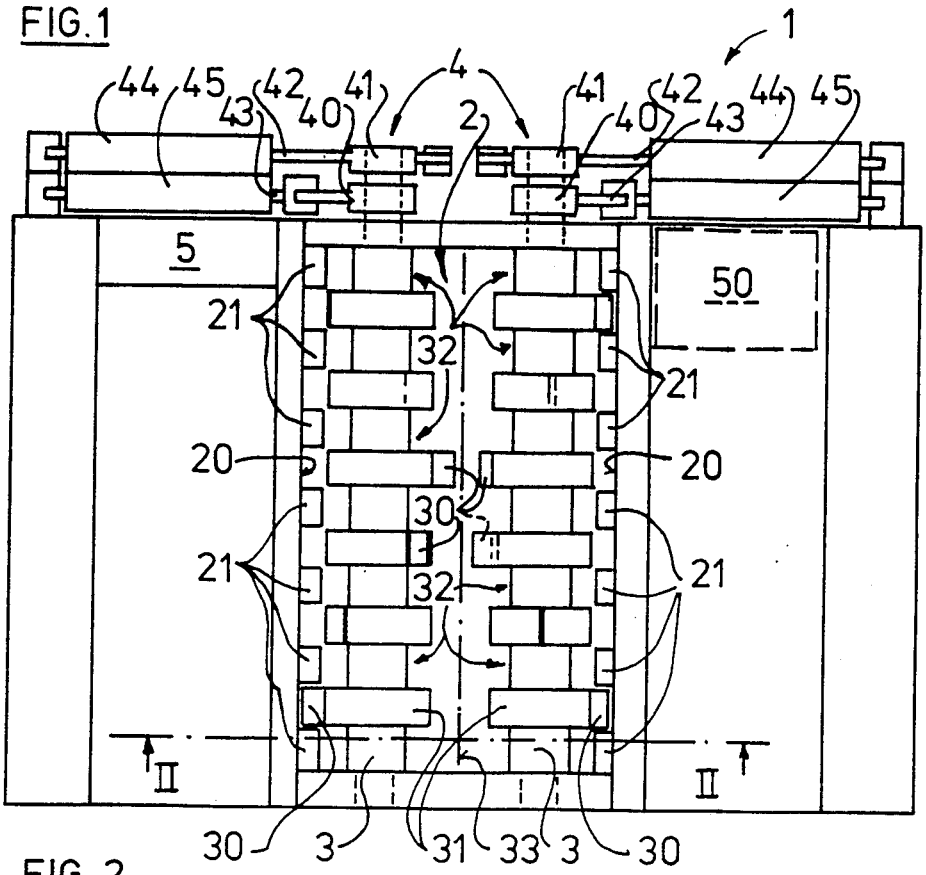
Figure 2:
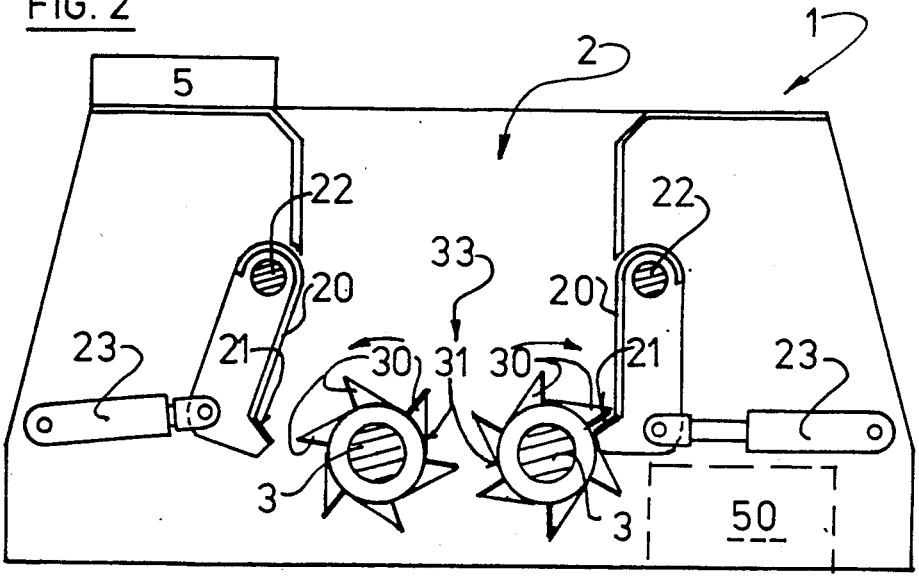
FIG. 2 is a section along the line II—II in FIG. 1.

Describing now the drawings, it is to be understood that to simplify the showing thereof, only enough of the structure of the roll cutting machine for comminution of bulky waste material or refuse or the like, has been illustrated therein as is needed to enable one skilled in the art to readily understand the underlying principles and concepts of this invention. Turning now specifically to FIGS. 1 and 2 of the drawings, the machine depicted by way of example and not limitation therein will be seen to comprise a roll cutting machine 1 which possesses a hopper 2 in which two rolls or rollers 3 are arranged essentially parallel to each other.

The hopper 2 contains two hopper wall sections 20 which are disposed essentially parallel to the rolls 3. The hopper wall sections 20 carry related hopper teeth 21 at their lower ends or lower regions. Each of the hopper wall sections 20 is pivotable about a pivot axle or pivot shaft 22 which extends parallel to the rolls 3, by means of an associated hydraulic cylinder 23, and is thus displaceable from its operative position which is shown in FIG. 1 for both rolls 3 and depicted in FIG. 2 on the right-hand side thereof for one of these rolls 3, into its inoperative position which is shown on the left-hand side in FIG. 2 for the other such roll 3, and vice-versa.

Each of the rolls 3 has roll teeth or cutters 30 which are offset from each other in circumferential direction. The roll teeth or cutters 30 are provided on annular zones 31 spaced in axial direction with annular grooves 32 therebetween on each roll 3.

The roll teeth or cutters 30 extend to the center up to the region of a common roll nip or gap 33 formed between the rolls 3 and also between the hopper teeth 21 when the related hopper wall section 20 is in the operative position which for both rolls 3 is shown in FIG. 1 and on the right-hand side in FIG. 2 for one of these two rolls 3. In this operative position of the hopper wall section 20 also the annular zones 31 extend close to the hopper teeth 21, whereas the annular grooves 32 are spaced from the respective oppositely located hopper teeth 21 so that comminuted or cut material can fall off the hopper teeth 21.

Figure 3:
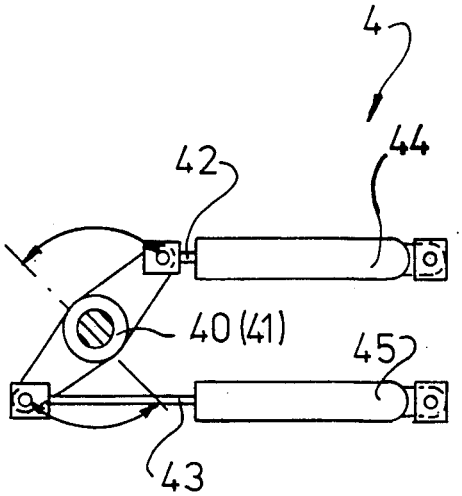
FIG. 3 is a schematic illustration of a preferred roll drive for use in the roll cutting machine shown in FIG. 1.

Each roll 3 is individually driven by its own hydraulic rotary drive or drive means 4, see FIGS. 1 and 3. Each roll drive or drive means 4 possesses two equally directed free-wheel mechanisms 40 and 41, see FIG. 3, which are operatively connected with related levers or piston rods 42 and 43. Related hydraulic cylinders 44 and 45 are operatively connected with the levers or piston rods 42 and 43.

A control or control means 5 serves for charging the hydraulic cylinders 23, 44 and 45 with hydraulic oil from a pump installation 50, see FIG. 1, and in accordance with the position of such hydraulic cylinders 23, 44, 45.

As long as the material, here not particularly shown, which falls into the hopper 2 from above, can be cut, the hopper wall sections 20 are in their operative position and the rolls 3 run or rotate from the top of the common roll nip or gap 31 away towards the hopper teeth 21.

When uncuttable material is jammed between the hopper teeth 21 and the roll teeth or cutters 30, then the control or control means 5 which monitors or controls the pressure prevailing in the hydraulic cylinders 44 and 45, causes the hydraulic cylinder 23 associated with one or each one of the hopper wall sections 20 to retract, whereby the related hopper wall section 20 or both hopper wall sections 20 are pivoted or displaced away from the associated roll or rolls 3 into their inoperative position. The jammed material then can pass through downwardly, the pressure in the hydraulic cylinders 44 and 45 of the roll drive or drive means 4 is restored to the normal value and the control or control means 5 causes the hydraulic cylinder or cylinders 23 to pivot back the related hopper wall section or sections 20 into the operative position.

In the roll cutting machine shown in the drawings, all the hopper teeth 21 on one hopper side are pivotable together with the related hopper wall section 20. Instead, however, groups of teeth or individual hopper teeth can be pivotably arranged if required by the type of material being processed.

In accordance with the invention and as illustrated, coarse teeth can be provided without any risks because the individual forces can be large. This is constructionally advantageous.

While there are shown and described present preferred embodiments of the invention, it is to be distinctly understood that the invention is not limited thereto, but may be otherwise variously embodied and practiced within the scope of the following claims.

Accordingly, what I claim is:

1. A roll cutting machine for comminution of bulky refuse, comprising:

a charging hopper;

two rolls arranged substantially axially parallel to each other;

rotary drive means for rotatably driving said two rolls in opposite directions of rotation;

said two rolls forming a common roll gap therebetween;

each one of said two rolls being provided with a predetermined number of axially spaced annular zones;

each one of said predetermined number of annular zones being provided with a related roll tooth;

each roll tooth of each annular zone of each roll being radially spaced from the related roll tooth at the annular zone of the other roll of said two rolls so that the roll teeth at said two rolls fail to overlappingly interleave with one another at the region of the common roll nip;

said charging hopper possessing two hopper wall sections each of which is arranged adjacent a related one of said two rolls;

said rotary drive means rotatably driving said two rolls in said opposite directions of rotation such that each one of said two rolls is rotatably driven in a direction away from the top side of said common roll gap towards a related one of said two hopper wall sections which is arranged adjacent each said related roll;

each one of said two hopper wall sections containing a lower region and being provided in said lower region with a predetermined number of hopper teeth and tooth spacings therebetween;

said predetermined number of hopper teeth being displaceable between an operative position and an inoperative position;

each roll tooth of each one of said two rolls, when said two rolls are rotatably driven by said rotary drive means, cuttingly passing through a related one of said tooth spacings between related ones of said hopper teeth of a related one of said two hopper wall sections and in said operative position of said predetermined number of hopper teeth;

means for displacing a preselected number of said predetermined number of hopper teeth of each one of said two hopper wall sections into said inoperative position in response to the action of a predetermined force effective between said preselected number of hopper teeth and related ones of said roll teeth;

said displacing means serving to displace said hopper teeth away from said related one of said two rolls into said inoperative position;

said preselected number of said hopper teeth of each of said two hopper wall sections being pivotably displaceable in response to the action of said predetermined force and between said operative position and said inoperative position by pivoting said preselected number of said hopper teeth about a predetermined pivot axis which extends axially parallel to said related one of said two rolls in order to prevent blockage of the charging hopper by the bulky refuse.

2. The roll cutting machine as defined in claim 1, wherein:

said displacing means comprise independently controllable drive means for displacing said preselected number of hopper teeth of each one of said two hopper wall sections between said operative position and said inoperative position.

3. The roll cutting machine as defined in claim 2, further including:

control means controlling said displacement of said preselected number of hopper teeth of at least one of said two hopper wall sections from said operative position into said inoperative position;

said independently controllable drive means constituting hydraulic drive means in which pressure develops during operation of the roll cutting machine; and said control means initiating said displacement of said preselected number of hopper teeth of said at least one hopper wall section when a predetermined pressure is reached in said hydraulic drive means.

4. The roll cutting machine as defined in claim 2, wherein:

said rotary drive means for rotatably driving said two rolls in opposite directions of rotation, contain hydraulic rotary drive means for rotatably driving at least one of said two rolls;

said hydraulic drive means developing pressure during operation of the roll cutting machine;

control means controlling said displacement of said preselected number of hopper teeth of at least one of said two hopper wall sections from said operative position into said inoperative position;

said controllable drive means constituting hydraulic drive means in which pressure develops during operation of the roll cutting machine; and said control means initiating said displacement of said preselected number of hopper teeth of said at least one hopper wall section at predetermined pressures reached in said hydraulic rotary drive means and in said hydraulic drive means.

5. The roll cutting machine as defined in claim 1, wherein:

said rotary drive means for rotatably driving said two rolls in opposite directions of rotation, contain hydraulic rotary drive means for rotatably driving at least one of said two rolls;

said hydraulic drive means developing pressure during operation of the roll cutting machine;

control means controlling said displacement of said preselected number of hopper teeth of at least one of said two hopper wall sections from said operative position into said inoperative position; and said control means initiating said displacement of said preselected number of hopper teeth of said at least one hopper wall section when a predetermined pressure is reached in said hydraulic rotary drive means.

6. The roll cutting machine as defined in claim 1, wherein:

each one of said predetermined number of annular zones provided at a related one of said two rolls and provided with a related roll tooth, extending close to said predetermined number of hopper teeth provided at said hopper wall section with which said related roll is associated, in said operative position of said hopper teeth;

each one of said two rolls being provided with a predetermined number of annular grooves;

each one of said annular grooves being arranged adjacent at least one of said predetermined number of annular zones;

each one of said predetermined number of annular grooves being arranged opposite to a related one of said predetermined number of hopper teeth provided at said hopper wall section with which said related roll is associated; and each one of said predetermined number of annular grooves being arranged at a greater distance from said related hopper tooth than said at least one annular zone arranged adjacent said annular groove.

7. The roll cutting machine as defined in claim 1, wherein:

said roll teeth provided at said predetermined number of annular zones of each one of said two rolls are arranged in a circumferentially offset relationship with respect to each other.

8. The roll cutting machine as defined in claim 1, wherein:

said rotary drive means for rotatably driving said two rolls in opposite directions of rotation, constitute individual rotary drive means operatively associated with a related one of said two rolls.

9. The roll cutting machine as defined in claim 1, wherein:

said rotary drive means include a predetermined number of free-wheel mechanisms operatively associated with each one of said two rolls;

a predetermined number of hydraulic motors each of which is operatively associated with a related one of said predetermined number of free-wheel mechanisms; and each one of said at least two rolls being individually rotatably drivable by means of said predetermined number of free-wheel mechanisms which are alternatingly operated by said predetermined number of hydraulic motors.

10. The roll cutting machine as defined in claim 1, wherein:

said rotary drive means rotatably driving said two rolls only in said directions of rotation such that each one of said two rolls is rotatably driven only in a direction away from the top side of said common roll gap towards a related one of said two hopper wall sections which is arranged adjacent each related roll.

* * * * *